US011421295B2

(12) United States Patent
Kong et al.

(10) Patent No.: US 11,421,295 B2
(45) Date of Patent: Aug. 23, 2022

(54) ULTRA HIGH STRENGTH HOT ROLLED STEEL SHEET HAVING LOW DEVIATION OF MECHANICAL PROPERTY AND EXCELLENT SURFACE QUALITY, AND METHOD FOR MANUFACTURING SAME

(71) Applicant: POSCO, Pohang-si (KR)

(72) Inventors: Jong-Pan Kong, Gwangyang-si (KR); Jea-Sook Chung, Gwangyang-si (KR)

(73) Assignee: POSCO, Pohang-si (KR)

( * ) Notice: Subject to any disclaimer, the term of this patent is extended or adjusted under 35 U.S.C. 154(b) by 172 days.

(21) Appl. No.: 16/628,436

(22) PCT Filed: Jul. 6, 2018

(86) PCT No.: PCT/KR2018/007718
§ 371 (c)(1),
(2) Date: Jan. 3, 2020

(87) PCT Pub. No.: WO2019/009675
PCT Pub. Date: Jan. 10, 2019

(65) Prior Publication Data

US 2020/0157648 A1 May 21, 2020

(30) Foreign Application Priority Data

Jul. 6, 2017 (KR) ..... 10-2017-0085932

(51) Int. Cl.
*C21D 9/46* (2006.01)
*C21D 6/00* (2006.01)
(Continued)

(52) U.S. Cl.
CPC ..... *C21D 9/46* (2013.01); *C21D 6/002* (2013.01); *C21D 6/005* (2013.01); *C21D 6/008* (2013.01);
(Continued)

(58) Field of Classification Search
CPC ..... B21B 1/46; B21B 45/08; C21D 2211/002; C21D 2211/005; C21D 2211/008;
(Continued)

(56) References Cited

U.S. PATENT DOCUMENTS 6,364,968 B1 * 4/2002 Yasuhara ..... C21D 1/20 148/320
2004/0031544 A1 * 2/2004 Hara ..... C21D 8/10 148/521
(Continued)

FOREIGN PATENT DOCUMENTS

CN 101285156 10/2008
CN 101657558 2/2010
(Continued)

OTHER PUBLICATIONS

NPL: on-line translation of JP 2010248601 A, Nov. 2010 (Year: 2010).*
(Continued)

*Primary Examiner* — Jie Yang
(74) *Attorney, Agent, or Firm* — Cantor Colburn LLP

(57) ABSTRACT

Provided is an ultra high-strength hot-rolled steel sheet, having tensile strength of 800 MPa, and a method for manufacture same, the method enabling excellent surface quality, workability, weldability as well as significantly reduced deviation of the mechanical property in the width and length directions of the steel sheet by means of an endless rolling mode in a continuous casting-direct rolling process.

6 Claims, 5 Drawing Sheets

(51) Int. Cl.

| | |
|---|---|
| ***C21D 8/02*** | (2006.01) |
| ***C22C 38/00*** | (2006.01) |
| ***C22C 38/02*** | (2006.01) |
| ***C22C 38/06*** | (2006.01) |
| ***C22C 38/26*** | (2006.01) |
| ***C22C 38/28*** | (2006.01) |
| ***C22C 38/32*** | (2006.01) |
| ***C22C 38/38*** | (2006.01) |

(52) U.S. Cl.
CPC ..... *C21D 8/0205* (2013.01); *C21D 8/0226* (2013.01); *C21D 8/0263* (2013.01); *C22C 38/001* (2013.01); *C22C 38/002* (2013.01); *C22C 38/02* (2013.01); *C22C 38/06* (2013.01); *C22C 38/26* (2013.01); *C22C 38/28* (2013.01); *C22C 38/32* (2013.01); *C22C 38/38* (2013.01); *C21D 2211/002* (2013.01); *C21D 2211/005* (2013.01); *C21D 2211/008* (2013.01)

(58) Field of Classification Search
CPC ..... C21D 6/002; C21D 6/005; C21D 6/008; C21D 8/0205; C21D 8/0226; C21D 8/0263; C21D 9/46; C22C 38/001; C22C 38/02; C22C 38/06; C22C 38/38
USPC ..... 148/320
See application file for complete search history.

(56) References Cited

U.S. PATENT DOCUMENTS

| | | | | |
|---|---|---|---|---|
| 2010/0132849 | A1 | 6/2010 | Takagi et al. | |
| 2014/0242414 | A1 | 8/2014 | Minami et al. | |
| 2014/0295210 | A1 | 10/2014 | Ariga et al. | |
| 2016/0017465 | A1 | 1/2016 | Toda et al. | |
| 2016/0289788 | A1 | 10/2016 | Shibata et al. | |
| 2017/0051376 | A1* | 2/2017 | Tada ..... | C21D 8/0268 |

FOREIGN PATENT DOCUMENTS

| | | |
|---|---|---|
| CN | 103703157 | 4/2014 |
| CN | 105793458 | 7/2016 |
| EP | 0860215 | 8/1998 |
| EP | 2557184 | 2/2013 |
| JP | 09241739 | 9/1997 |
| JP | H10277715 | 10/1998 |
| JP | 2009019265 | 1/2009 |
| JP | 2009209384 | 9/2009 |
| JP | 2010248601 | 11/2010 |
| JP | 2011241456 | 12/2011 |
| JP | 2013100574 | 5/2013 |
| JP | 2015190015 | 11/2015 |
| JP | 2016166388 | 9/2016 |
| KR | 20070041645 | 4/2007 |
| KR | 20140043156 | 4/2014 |
| KR | 20140081048 | 7/2014 |
| KR | 20150121161 | 10/2015 |
| KR | 20160090363 | 7/2016 |
| KR | 20170054622 | 5/2017 |

OTHER PUBLICATIONS

NPL: on-line translation of JP 2011241456 A, Dec. 2011 (Year: 2011).*

International Search Report—PCT/KR2018/007718 dated Oct. 15, 2018.

Kong, et al., Effect of alloying elements on expulsion in electric resistance spot welding of advanced high strength steels, Science and Technology of Welding and Joining, 2016, pp. 32-42.

Chinese Office Action—Chinese Application No. 201880044819.4 dated Dec. 17, 2020, citing KR 10-2017-0054622, CN 103703157, JP 2011-241456, CN 101657558, CN 105793458, and EP 2557184.

Japanese Office Action—Japanese Application No. 2019-572684 dated Feb. 9, 2021, citing JP H10-277715, KR 10-2014-0081048, JP 2016-166388, JP 2015-190015, JP 2010-248601, JP 2009-019265, JP2009-209384, and JP 2013-100574.

* cited by examiner

ULTRA HIGH STRENGTH HOT ROLLED STEEL SHEET HAVING LOW DEVIATION OF MECHANICAL PROPERTY AND EXCELLENT SURFACE QUALITY, AND METHOD FOR MANUFACTURING SAME

TECHNICAL FIELD

The present disclosure relates to an ultra high strength hot rolled steel sheet having low deviations of mechanical properties and excellent surface quality and a method for manufacturing the same using an endless rolling mode in a continuous casting-direct rolling process.

BACKGROUND ART

The automobile industry accounts for a majority of demand for steel. Due to strong global demand for vehicle passenger collision stability and $CO_2$ environmental regulations, there is a need to realize ultra high-strength and ultra lightweightness of the vehicle body. In response to such need, ultra high-strength steel sheets of 780 MPa or more have been actively developed.

In general, cold-rolled steel sheets are mainly utilized in parts where a complicated shape is required in vehicles, and for structural members, such as a reinforcement material, a wheel, a chassis, and the like, hot-rolled steel sheets are mainly used.

The workability of hot-rolled steel sheets is classified into bendability, stretchability and stretch flangeability. The characteristics required for automotive chassis parts, such as disks, lower arms, and the like, and wheels of vehicle, is stretch flangeability.

The stretch flangeability, evaluated as hole expandability, is known to be relevant to microstructures of steel sheets. In the case of precipitation-hardening hot-rolled steel sheets, which have widely been used in recent years, however, elongation and flangeability are reduced as strength increases, thereby making it difficult to apply the hot-rolled steel sheets to parts such as automobile chassis, and the like. To solve this problem, a method of securing elongation and flangeability has been developed by forming a mixed structure including polygonal ferrite or acicular ferrite and bainite.

In order to sufficiently obtain a bainite structure, coiling needs to be carried out at a temperature of 350° C. to 550° C.; however, a heat transfer coefficient drastically changes in said temperature range, and a temperature hit ratio is lowered during coiling, thereby making it difficult to control the microstructure. In particular, when high-strength multiphase steel is manufactured in a conventional hot rolling mill, the final finish rolling speed is conventionally as high as 500 mpm. Accordingly, it is difficult to control the coiling temperature to constantly be 350° C. to 550° C., and it is difficult to stably obtain the bainite and bainitic ferrite structures.

Further, the conventional hot rolling mill has a problem that deviations in mechanical properties in the width and length directions may be high as the rolling speed at the tail portion is inevitably high to maintain the finish rolling temperature constant. Due to issues with rolling sheet breakage and rolling workpiece transfer characteristics, it is difficult to produce a thin material having a thickness of 2.8 mm or less using the conventional hot rolling mill. The finish rolling is carried out at a temperature near Ar3 (initiation temperature of ferrite transformation)+(80° C. to 100° C.), thereby making the size of grains coarse. When cooling, multistage cooling (conventionally, 3 stages) needs to be carried out. In this regard, it is difficult to control the coiling temperature due to complicated cooling patterns.

Meanwhile, a manufacturing process (mini-mill process) employing use of thin slabs, a new steel manufacturing process, has drawn attention as a potential process to manufacture phase-transformation steel having low deviations in mechanical properties due to low temperature deviation in width and length directions of steel strips.

Although there have been studies on manufacturing methods of DP steel and TRIP steel using a batch mode in conventional mini-mill process, a thickness of final steel sheet is limited to be 3.0 mm. This is because the conventional mini-mill process is a batch-type process in which a bar plate is coiled in a coil box and is then uncoiled, and the coiling and uncoiling of the bar plate need to be carried out each time one steel sheet is produced. Accordingly, straight transfer and passingability are poor during finish rolling, and due to significantly high risk of sheet breakage, it is difficult to produce a hot-rolled coil having a thickness of 3.0 mm or less.

Accordingly, in order to overcome the above problems and in response to the demand for high strength and lightweightness, there is an urgent need for the development of ultra high-strength thin steel sheet (a thickness of 2.8 mm or less) having excellent tensile strength, elongation and stretch flangeability and a manufacturing method therefor.

PRIOR ART (Non-Patent Document 1) J.-P. Kong, Science and Technology of Welding and Joining, Vol. 21, No. 1, 2016

DISCLOSURE

Technical Problem

An aspect of the present disclosure is to provide an ultra high-strength hot-rolled steel sheet having tensile strength of 800 MPa grade, excellent surface quality, workability, weldability as well as significantly reduced deviation of the mechanical property in the width and length directions of the steel sheet by means of an endless rolling mode in a continuous casting-direct rolling process, and a method for manufacture the same.

Meanwhile, the technical problem of the present disclosure is not limited to the above. The technical problem of the present disclosure will be clearly understood by those skilled in the art through the following description without difficulty.

Technical Solution

An aspect of the present disclosure relates to an ultra high-strength hot-rolled steel sheet having low deviations in mechanical properties and excellent surface quality containing, by wt %, carbon (C): 0.03% to 0.08%, manganese (Mn): 1.6% to 2.6%, silicon (Si): 0.1% to 0.6%, phosphorous (P): 0.005% or 0.03%, sulfur (S): 0.01% or less, aluminum (Al): 0.05% or less, chromium (Cr): 0.4% to 2.0%, titanium (Ti): 0.01% to 0.1%, niobium (Nb): 0.005% to 0.1%, boron (B): 0.0005% to 0.005%, nitrogen (N): 0.001% to 0.01%, and retained iron (Fe) and inevitable impurities, wherein the ultra high-strength hot-rolled steel sheet has a microstructure containing, by area %, a sum of ferrite and bainitic ferrite of 30% to 70%, bainite of 25% to 65%, and martensite of 5% or less.

Another aspect of the present disclosure relates to method for manufacturing an ultra high-strength hot-rolled steel sheet having low deviations in mechanical properties and excellent surface quality, including continuously casting molten steel containing, by wt %, carbon (C): 0.03% to 0.08%, manganese (Mn): 1.6% to 2.6%, silicon (Si): 0.1% to 0.6%, phosphorous (P): 0.005% or 0.03%, sulfur (S): 0.01% or less, aluminum (Al): 0.05% or less, chromium (Cr): 0.4% to 2.0%, titanium (Ti): 0.01% to 0.1%, niobium (Nb): 0.005% to 0.1%, boron (B): 0.0005% to 0.005%, nitrogen (N): 0.001% to 0.01%, and retained iron (Fe) and inevitable impurities, to obtain a thin slab having a thickness of 60 mm to 120 mm; spraying cooling water onto the thin slab at a pressure of 50 bars to 350 bars to remove scale; rough rolling the thin slab from which scale has been removed to obtain a bar plate; spraying the cooling water onto the bar plate at a pressure of 50 bars to 350 bars to remove scale; finish rolling the bar plate, from which scale has been removed, within a temperature range of (Ar3-20° C.) to (Ar3+60° C.) to obtain a hot-rolled steel sheet; and air-cooling the hot-rolled steel sheet for 2 sec to 8 sec followed by cooling at 80° C./sec to 250° C./sec to coil within a temperature range of (Bs−200° C.) to (Bs+50° C.), wherein the processes are continuously carried out.

The technical solutions above are not all features of the present disclosure. Various features of the present disclosure and advantages and effects thereof can be understood in more detail with reference to the following specific embodiments.

Advantageous Effects

The present disclosure has an effect in that an ultra high-strength hot-rolled steel sheet and a method for manufacturing the same using an endless rolling mode in a continuous casting-direct rolling process can be provided, the steel sheet not only having excellent surface quality, workability and weldability but also significantly reduced deviation of the mechanical property in the width and length directions of the steel sheet. The steel sheet also has a tensile strength of 800 MPa grade and a thickness of 2.8 mm or less as well as excellent percentage yield.

Accordingly, the present disclosure is differentiated from existing hot rolling mill and mini-mill batch process, which enable production of hot-rolled steel plate (a thickness of at least 3.0 mm) only, and may skip a reheating process in the existing hot rolling mill, thereby promoting energy saving and productivity improvement.

In addition, as steel obtained by melting scraps, such as scrap metal, in an electric furnace can be used via thin slab continuous casting, recycling of resources can be improved.

BRIEF DESCRIPTIONS OF DRAWINGS

BEST MODE

Figure 1:
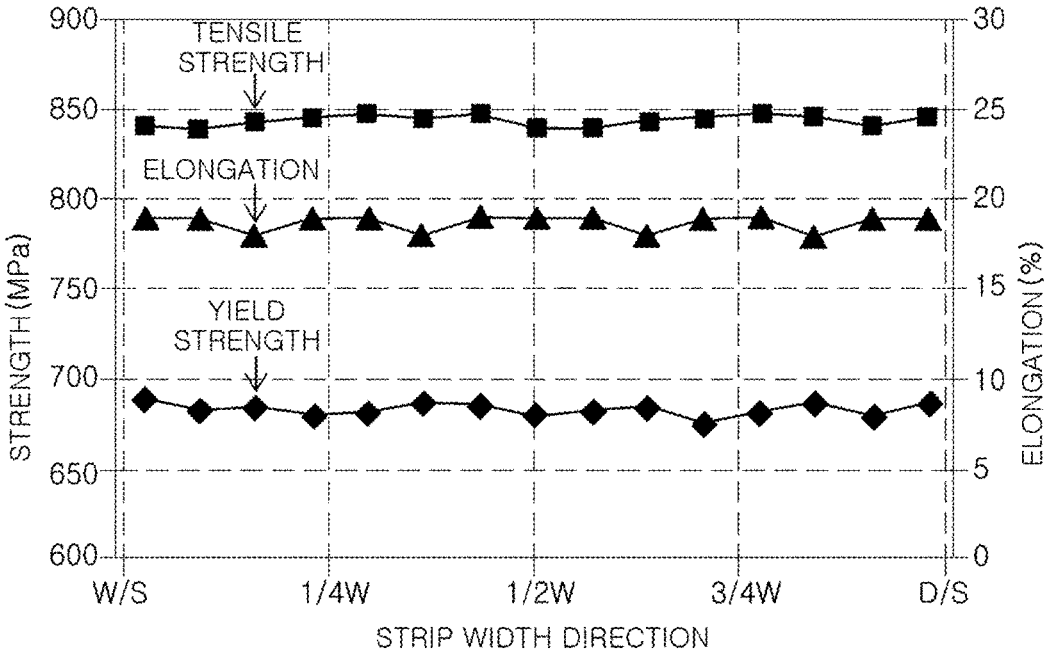
FIG. 1 is a profile of Inventive Example 2.

Preferred embodiments of the present disclosure will now be described. However, the present disclosure may be embodied in many different forms and should not be construed as being limited to the embodiments set forth herein. Rather, these embodiments are provided so that this disclosure will be thorough and complete, and will fully convey the scope of the invention to those skilled in the art.

The present inventors have recognized that existing hot rolling processes have a large deviations in mechanical properties in the width and length directions due to a tail portion rolling speed acceleration and multi-stage cooling to secure uniform finish rolling in the length direction within a single strip and involve problems such as plate breaking and passingability during finish rolling, thereby making it difficult to produce a thin hot-rolled steel sheet. The present inventors have also recognized that the existing mini-mill batch processes is not suitable for producing a thin hot-rolled steel sheet (a thickness of 3.0 mm or less) and may cause problems such as edge defects and surface quality deterioration. In this regard, the present inventors have conducted deep research to solve these problems.

As a result, the present inventors have found that use of an endless rolling mode in a continuous casting-direct rolling process while precisely controlling an alloy composition and the manufacturing processes will facilitate manufacture of an ultra high-strength hot-rolled steel sheet having tensile strength of 800 MPa grade and a thickness of 2.8 mm or less with not only having excellent surface quality, workability and weldability but also significantly reduced deviation of the mechanical property in the width and length directions of the steel sheet, thereby completing the present disclosure.

Hereinafter, an ultra high-strength hot-rolled steel sheet according to an aspect of the present disclosure, having low deviation of the mechanical property and excellent surface quality, will be described in detail.

The ultra high-strength hot-rolled steel sheet according to the aspect of the present disclosure having low deviations in mechanical properties and excellent surface quality contains, by wt %, C: 0.03% to 0.08%, Mn: 1.6% to 2.6%, Si: 0.1% to 0.6%, P: 0.005% or 0.03%, S: 0.01% or less, Al: 0.05% or less, Cr: 0.4% to 2.0%, Ti: 0.01% to 0.1%, Nb: 0.005% to 0.1%, B: 0.0005% to 0.005%, N: 0.001% to 0.01%, and retained Fe and inevitable impurities, wherein the ultra high-strength hot-rolled steel sheet has a microstructure containing, by area %, a sum of ferrite and bainitic ferrite of 30% to 70%, bainite of 25% to 65%, and martensite of 5% or less.

The alloy composition of the present disclosure will be described in detail. In the following description, the unit of a content of each element is given in wt %, unless otherwise indicated.

C: 0.03% to 0.08%

Carbon (C) is an important element added to ensure strength of transformed structure steel. When C is contained in an amount of less than 0.03%, it may be difficult to achieve target strength, whereas a hypo-peritectic reaction (L+delta-ferrite austenite) may occur during solidification of a molten steel when C is contained in an amount exceeding 0.08%, thereby producing a solidified shell having an ununiform thickness and causing leakage of molten steel. This may lead to operational accidents. Therefore, it is preferable that an amount of C be 0.03% to 0.08%. The amount of C is more preferably 0.035% to 0.075%, and most preferably 0.04% to 0.07%.

Mn: 1.6% to 2.6%

Manganese (Mn) is an element serving a role for solid solution strengthening when present in steel. When Mn is contained an amount of less than 1.6%, target strength may not be easily achieved. In contrast, when the Mn amount exceeds 2.6%, not only elongation but also weldability and hot rolling properties may deteriorate. In addition, an excessive amount of Mn may result in a hypo-peritectic reaction even in a low C region by reducing a delta-ferrite region at a temperature near solidification. In this regard, solidified shell having an ununiform thickness during high speed continuous casting and causing leakage of molten steel, which may lead to operational accidents. Accordingly, the amount of Mn is preferably 1.6% to 2.6%, more preferably 1.65% to 2.55%, most preferably 1.8% to 2.5%.

Si: 0.1% to 0.6%

Silicon (Si) is an element useful in obtaining ductility of a steel sheet. Si also promotes formation of ferrites and encourages C enrichment to untransformed austenite to promote formation of martensite. When Si is contained an amount of less than 0.1%, it is difficult to sufficiently guarantee said effects. When the Si amount is greater than 0.6%, however, red scale may be formed on a surface of the steel sheet, and traces thereof may remain on the surface of the steel sheet after pickling, thereby lowering surface quality. Accordingly, the amount of Si is preferably 0.1% to 0.6%, more preferably 0.1% to 0.5%, most preferably 0.1% to 0.3%.

P: 0.005% to 0.03%

Phosphorus (P) is an element enhancing strength of a steel sheet. When P is contained in an amount of less than 0.005%, it is difficult to achieve said effect, whereas when P is contained in an amount of greater 0.03%, embrittlement may be induced by segregation along grain boundaries and/or interphase boundaries. Accordingly, it is preferable that the amount of P be adjusted to 0.005% to 0.03%. The amount of P is more preferably 0.0055% to 0.020%, most preferably 0.006% to 0.015%.

S: 0.01% or less

Sulfur (S) is an impurity which may induce MnS non-metallic inclusions in steel and high temperature cracks by segregating during solidification in the continuous casting. Accordingly, the amount of S should be adjusted to be as low as possible, preferably to 0.01% or less.

Al: 0.05% or less

Aluminum (Al) may deteriorate plateability of the steel sheet due to concentration on a surface of the steel sheet but may suppress formation of carbides to increase ductility of the steel sheet. Meanwhile, in the case of a thin slab, reheating can be omitted from the conventional hot mill process, which can save energy and improve productivity; however, a temperature of the surface or edge region of the slab may be decreased due to strong cooling of the slab surface. This may result in excessive precipitation of AlN, thereby leading to inferior edge quality of a slab and/or a bar plate due to high temperature ductility reduction. Accordingly, the amount of Al should be adjusted to be as low as possible, preferably to 0.05% or less.

Cr: 0.4% to 2.0%

Chromium (Cr) is an element enhancing hardenability and increasing strength of steel. When Cr is contained in an amount of less than 0.4%, said effect may be insufficient. In contrast, ductility of the steel sheet may be reduced when the Cr amount is greater than 2.0%. Accordingly, the Cr amount is preferably 0.4% to 2.0%, more preferably 0.5% to 1.8%, most preferably 0.6% to 1.6%.

Ti: 0.01% to 0.1%

Titanium (Ti), as an element for forming precipitates and nitrides, increases strength of steel. When Ti is contained in an amount of less than 0.01%, said effect may be insufficient. In contrast, the Ti amount is greater than 0.1%, manufacturing costs may increase, and ductility of ferrites may decrease. Accordingly, the Ti amount is preferably 0.01% to 0.1%, more preferably 0.02% to 0.08%, most preferably 0.03% to 0.06%.

Nb: 0.005% to 0.1%

Niobium (Nb) is an element effective for increasing strength of a steel sheet and miniaturizing a particle diameter. When Nb is contained in an amount of less than 0.005%, said effect may be insufficient. In contrast, the Nb amount greater than 0.1% increases manufacturing costs may deteriorate ductility of ferrites and induce edge cracks of a slab/bar plate. Accordingly, the amount of Nb is preferably 0.005% to 0.1%, more preferably 0.010% to 0.08%, most preferably 0.015% to 0.06%.

B: 0.0005% to 0.005%

Boron (B) is an element delaying transformation of austenite into pearlite during cooling. When B is contained in an amount of less than 0.0005%, said effect may be insufficient, whereas the B amount of greater than 0.005% may significantly increase hardenability, thereby deteriorating workability. Accordingly, it is preferable that the B amount be 0.0005% to 0.0050%. The B amount is more preferably 0.0010% to 0.0040%, most preferably 0.0015% to 0.0035%.

N: 0.001% to 0.01%

Nitrogen (N) is an element stabilizing austenite and forming nitrides. When N is contained in an amount of less than 0.001%, said effect is insufficient. In contrast, when the amount of N is greater than 0.01%, N reacts with a precipitation-forming element and may increase precipitation strengthening effect but may drastically decrease ductility. Accordingly, it is preferable that N be contained in an amount of 0.001% to 0.01%. The amount of N is more preferably 0.002% to 0.009%, most preferably 0.003% to 0.008%.

The remaining ingredient of the ultra high-strength hot-rolled steel sheet of the present disclosure is Fe; however, in conventional manufacturing processes, undesired impurities from raw materials or manufacturing environments may be inevitably mixed, and thus cannot be excluded. Such impurities are well-known to those of ordinary skill in the art, and thus, specific descriptions thereof will not be mentioned in the present disclosure.

It is preferable that the contents of Ti, Nb and B be precisely controlled not only to satisfy the above numerical ranges, but also to satisfy Equations 1 to 3 based on the N content in order to secure the high strength while improving surface and edge qualities. In Equations 1 to 3 below, each element symbol represents a content of each element expressed in weight %.

Precipitates of Ti, Nb and B are elements effective in strength improvement; however, when the precipitates of Nb and B are excessively formed, high temperature ductility decreases. Conventional hot rolling mill, which employs long time reheating of a slab having a thickness of 200 mm to 250 mm in a furnace having a temperature of 1000° C. to 1200° C., has a high slab edge temperature, thereby making high temperature ductility not problematic. However, in a continuous casting-direct rolling process of the present disclosure, when an excessive amount of precipitates are formed and the high temperature ductility is reduced due to low surface and/or edge temperature of a slab and/or a bar plate, may have adverse effects on the surface and/or edge quality and thus require more precise control.

$$3.4N \leq Ti \leq 3.4N+0.05 \quad \text{Equation 1:}$$

Ti is an element for forming precipitates and nitrides and increases strength of steel. Ti also removes soluble N through formation of TiN at a near solidification temperature and decreases amounts of Nb(C,N), AlN and BN precipitates to prevent high temperature ductility deterioration, thereby reducing edge crack generation sensitivity. Accordingly, Ti is a significantly useful element in solving the surface and/or edge quality problems caused during thin slab high speed continuous casting and securing the strength, and accordingly, precise control thereof is required.

When the Ti content is less than (3.4N) %, said effects may be insufficient. In contrast, the Ti content greater than (3.4N+0.05) % may increase manufacturing costs and lower ductility of the ferrite.

$$6.6N-0.02 \leq Nb \leq 6.6N \quad \text{Equation 2:}$$

Nb is an element effective for increasing the strength of a steel sheet and miniaturizing a particle diameter. When an amount of Nb is less than (6.6N−0.02) %, it may be difficult to secure said effect. When the Nb amount is greater than (6.6N) %, excessive amounts of precipitates such as NbC, Nb(C,N), (Nb, Ti) (C, N), or the like, may be formed, resulting in inferior edge quality of the slab and/or bar plate due to reduced high temperature ductility. The ductility of ferrite may also be reduced.

$$0.8N-0.0035 \leq B \leq 0.8N \quad \text{Equation 3:}$$

B is an element delaying transformation of austenite into pearlite during cooling in annealing. When an amount of B is less than (0.8N−0.0035) %, said effect may be insufficient. The amount of B greater than (0.8N) % may greatly increase hardenability, which may cause deterioration of workability. Excessive amounts of precipitates such as BN, or the like, may be formed, resulting in inferior edge quality of a slab and/or the bar plate.

In addition to the above-described alloying elements, the ultra high-strength hot-rolled steel sheet may include at least one of Cu, Ni, Sn, and Pb as a tramp element, a total amount of which may be 0.2 wt % or less. Such a tramp element is an impurity element generated from scrap used as a raw material in a steelmaking process. When the total amount thereof exceeds 0.2%, surface cracking may occur in a thin slab, and surface quality of the hot-rolled steel sheet may deteriorate.

Further, not only the previously described alloy composition is satisfied but also Ceq (carbon equivalent) represented by Equation 4 below may be 0.14 to 0.24. The Ceq is preferably 0.15 to 0.23, and more preferably 0.16 to 0.22.

$$Ceq=C+Si/30+Mn/20+2P+3S \quad \text{Equation 4:}$$

(each element symbol in Equation 4 refers to a content of each element expressed in wt %)

Equation 4 above is a component relational equation for securing the weldability of steel sheets. In the present disclosure, Ceq may be adjusted to be within the range of 0.14 to 0.24 to guarantee high resistance spot weldability and impart excellent mechanical property to weld zones.

When Ceq is less than 0.14, it may be difficult to secure target tensile strength due to low hardenability. In contrast, Ceq greater than 0.24 may reduce weldability, thereby deteriorating physical properties of weld zones.

Further, expulsion limit current (ELC) represented by Equation 5 below may be 8 kA or above.

$$ELC\ (kA)=9.85-0.74Si-0.67Al-0.28C-0.20Mn-0.18Cr \quad \text{Equation 5:}$$

(each element symbol in Equation 5 refers to a content of each element expressed in wt %)

Equation 5 is a component relational equation for securing resistance spot weldability of the steel sheet disclosed in Non-Patent Document 1 and refers to upper limit current at which expulsion occurs. When expulsion occurs, pores and cracks may be generated in the weld zones, thereby reducing strength of the weld zones. Accordingly, the ELC is a very important indicator in resistance spot welding. The higher the ELC, the better the resistance spot weldability.

By controlling the ELC value to be 8 kA or more, excellent resistance spot weldability can be achieved. Conventionally, ELC may vary depending on a thickness, surface roughness, plating, welding conditions, and the like, of a material. Accordingly, the above evaluation criteria are based on the welding conditions of ISO18278-2, adopted by most of European automobile companies. When the ELC is less than 8 kA, it is difficult to apply to industrial sites as a proper welding section which can be welded is narrow. Furthermore, it may be difficult to secure excellent mechanical property of the weld zones as expulsion is likely to occur. Accordingly, it is preferable that an optimum alloy component be added such that the ELC value is 8 kA or more.

Hereinafter, the microstructure of the hot-rolled steel sheet of the present disclosure will be described in detail.

The microstructure of the hot-rolled steel sheet of the present disclosure includes, by area %, a sum of ferrite and bainitic ferrite of 30% to 70%, bainite of 25% to 65%, and martensite of 5% or less.

When the sum of the ferrite and bainitic ferrite is less than 30%, it is difficult to secure elongation and workability, whereas the sum greater than 70% makes it difficult to secure high strength. When the bainite is contained in an amount of less than 25%, it is difficult to secure high strength, whereas it is difficult to secure elongation and workability when the bainite amount is greater than 65%. In addition, an amount of martensite greater than 5% excessively increases strength, thereby making it difficult to secure ductility and workability.

The ferrite and the bainitic ferrite may have an average short-axis length of 1 μm to 5 μm. More preferably, the ferrite and the bainitic ferrite have an average short-axis length of 1.5 μm to 4.0 μm.

The control of the average short-axis length is to achieve both strength and workability through securing two structures having fine grains. In the case in which the average short-axis length is greater than 5 μm, it may be difficult to achieve target strength and workability. Accordingly, the average short-axis length is preferably 5 μm or less, more preferably 4 μm or less, most preferably 3 μm or less.

An average short-axis length of less than 1 μm may be advantageous in terms of the strength and workability improvement; however, Ti, a precipitate and nitride-forming element, and expensive Nb, V, Mo, and the like need to be added to control the length to be 1 μm. In this regard, manufacturing costs may increase, and high temperature ductility may decrease due to excessive formation of precipitates, and edge quality of a slab and/or a bar plate may deteriorate.

Meanwhile, the hot-rolled steel sheet of the present disclosure may include 5 pcs/μm$^2$ to 100 pcs/μm$^2$ of (Ti,Nb)(C,N) precipitates, more preferably 10 pcs/μm$^2$ to 80 pcs/

$\mu m^2$. The (Ti,Nb) (C,N) precipitates may have an average size measured in equivalent circular diameter of 50 nm or less.

As used herein, the expression "(Ti,Nb) (C,N) precipitates" refers to TiC, NbC, TiN, NbN, and complex precipitates thereof.

When a size of the precipitate is greater than 50 nm, it may be difficult to effectively secure the strength. In addition, when number of the precipitates is less than 5 pcs/$\mu m^2$, it may be difficult to achieve target strength. In contrast, when number of the precipitates is greater than 100 pcs/$\mu m^2$, elongation and hole expandability may deteriorate according to the increasing strength, thereby generating cracks during the processing.

Further, the hot-rolled steel sheet of the present disclosure may have a thickness of 2.8 mm or less. The conventional hot-rolling mill and mini-mill bath mode had difficulty with production of a thin material due to problems such as rolling plate breaking and passingability. According to the manufacturing method suggested in the present disclosure, however, a hot-rolled steel sheet can be manufactured stably to have a thickness of 2.8 mm or less. More preferably, the thickness of the hot rolled steel sheet may be 2.0 mm or less, more preferably 1.6 mm or less.

The hot-rolled steel sheet may have deviation of a tensile strength in the mechanical properties of 20 MPa or less and gloss of 10% or less, that is, low deviations in mechanical properties and excellent surface quality.

Further, the tensile strength (TS) may be 800 MPa or more, and the elongation (EL) may be 15% or more. No cracking occurs at the bendability R/t ratio of 0.25, and the hole expandability may be 50% or more.

Hereinafter, a method for manufacturing an ultra high-strength hot-rolled steel sheet having low deviations in mechanical properties and excellent surface quality, another aspect of the present disclosure, will be described in detail.

The method for manufacturing an ultra high-strength hot-rolled steel sheet having low deviations in mechanical properties and excellent surface quality includes continuously casting molten steel satisfying the above alloy composition to obtain a thin slab having a thickness of 60 mm to 120 mm; spraying cooling water onto the thin slab at a pressure of 50 bars to 350 bars to remove scale; rough rolling the thin slab from which scale has been removed to obtain a bar plate; spraying the cooling water onto the bar plate at a pressure of 50 bars to 350 bars to remove scale; finish rolling the bar plate, from which scale has been removed, within a temperature range of (Ar3-20° C.) to (Ar3+60° C.) to obtain a hot-rolled steel sheet; and air-cooling the hot-rolled steel sheet for 2 sec to 8 sec followed by cooling at 80° C./sec to 250° C./sec to coil within a temperature range of (Bs−200° C.) to (Bs+50° C.), wherein the processes are continuously carried out.

Each process being continuously carried out indicates use of continuous casting-direct rolling process in an endless rolling mode.

A manufacturing process (mini-mill process) utilizing a thin slab, a new steel manufacturing process, which has recently attracted attention, is a potential process facilitating manufacturing a structural transformation steel having minor deviations in mechanical properties due to low temperature deviation in the width and length directions of the strip as characteristics of the continuous casting-direct rolling process.

Such continuous casting-direct rolling process involves the conventional batch mode and the endless rolling mode, which has newly been being developed.

In the case of the batch mode, coiling is carried out in a coil box in front of the finish rolling mill, followed by finish rolling to compensate for a difference between a casting speed and a rolling speed. For this reason, problems such as reduced scale peelability, deteriorated surface quality, sheet breakage during production of steel sheets having a thickness of 3.0 mm or less, may arise.

The endless rolling mode, in contrast to the batch mode, does not involve coiling before the finish rolling, which indicates that said problems of the batch mode are irrelevant; however, more precise control is required to compensate the speed difference between the casting and the rolling.

Figure 8:
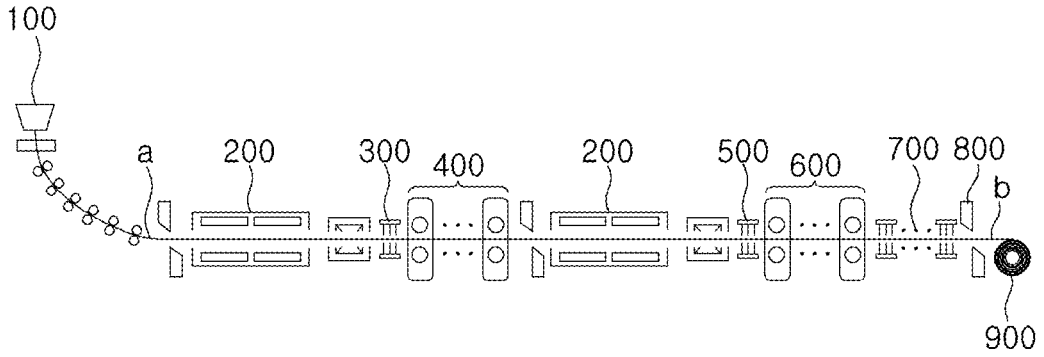
FIG. 8 is a schematic diagram illustrating a process using an endless rolling mode in a continuous casting-direct rolling process.

FIG. 8 is a schematic diagram illustrating an example of a process using the continuous casting-direct rolling process in the endless rolling mode. A continuous caster 100 is utilized to manufacture a thin slab (a) having a thickness of 50 mm to 150 mm. A coiling box is not present between a rough rolling mill 400 and a finish rolling mill 600, thereby enabling continuous rolling. This gives rise to excellent material movability and low risk of sheet breakage, thereby enabling production of a thin material having a thickness of 3.0 mm or less. As a roughing mill scale breaker (RSB) 300 and a finishing mill scale breaker (FSB) 500 are present in front of the rough rolling mill 400 and the finish rolling mill 600, respectively, surface scale is easily removed, and pickled & oiled (PO) materials having excellent surface quality when pickling a hot-rolled steel sheet in the subsequent processes can be produced. Further, as constant-temperature and constant-speed rolling is feasible as rolling speed difference between a top and a tail of a single steel sheet is 10% or less during the finish rolling, temperature deviation in the width and length directions of the steel sheet is significantly low, which enabling precise cooling control in a run out table (ROT) 700. As a result, a steel sheet having significantly low deviations in mechanical properties.

Hereinafter, each process will be described in detail.

Continuous Casting

Molten steel having the above-described alloying composition is continuously cast to obtain a thin slab having a thickness of 60 mm to 120 mm.

When the thickness of the thin slab is greater than 120 mm, not only high-speed casting is impractical but also a rolling load increases during rough rolling. When the thickness is less than 60 mm, a temperature of the cast rapidly decreases and it is difficult to form a uniform structure. In order to solve these problems, a heating device may additionally be installed; however, this is a factor which increases production costs and thus is preferably excluded. Accordingly, the thickness of the thin slab is limited to 60 mm to 120 mm. The thickness is more preferably 70 mm to 110 mm, most preferably 80 mm to 100 mm.

A casting speed of the continuous casting may be 4 mpm to 8 mpm.

The reason for setting the casting speed to be at least 4 mpm is that as the rolling process of the continuous casting is connected to that of the high-speed casting, the casting speed is required to be greater than a certain vale to obtain a target rolling temperature. When the casting speed is too low, there is a risk that segregation may occur from the cast, which may not only make it difficult to achieve strength and workability but also increase a risk that deviations in mechanical properties may be generated in the width or length direction. When the speed exceeds 8 mpm, an operational success rate may be reduced due to instability of molten steel level. The casting speed is preferably 4.2 mpm to 7.2 mpm, more preferably 4.5 mpm to 6.5 mpm.

Removing Thin Slab Scale

Cooling water is sprayed onto the heated thin slab at a pressure of 50 bars to 350 bars to remove scale. For example, the scale may be removed so as that the thickness of the surface scale becomes 300 μm or less by spraying the cooling water of 50° C. or less from a nozzle of the RSB at a pressure of 50 bars to 350 bars. When the pressure is less than 50 bars, a large amount of acid-water scale is present on the thin slab surface, thereby deteriorating the surface quality after pickling. In contrast, the pressure above 350 bars would drastically reduce an edge temperature of the bar plate, thereby creating edge cracks. The pressure of spraying the cooling water is more preferably 100 bars to 300 bars, most preferably 150 bars to 250 bars.

Rough Rolling

The scale-removed thin slab is subjected to rough rolling to obtain a bar plate. For example, the continuously cast thin slab is rough-rolled in a rough rolling mill consisting of 2 to 5 stands.

The rough rolling may be performed such that the thin bar plate has a surface temperature of 900° C. to 1200° C. on a rough rolling side and an edge temperature of 800° C. to 1100° C. on an exit side of the rough rolling.

The surface temperature of the thin slab less than 900° C. may increase a rough rolling load and generates cracks on the bar plate during the rough rolling, which may cause defects on the edge of the hot-rolled steel sheet. When the surface temperature exceeds 1200° C., problems such as deteriorated hot rolling surface quality due to the existing hot rolling scale may arise. Furthermore, an internal temperature of the cast is so high that uncondensation may occur, and the cast may swell before rough rolling, thereby leading to cast interruption. Further, bulging may occur and mold level hunting (MLH) may be severely generated, which may make it difficult to reduce the casting speed and carry out high speed casting. That is, the molten steel inside the mold may be shaken so hard that high speed casting may be impractical. The speed needs to be reduced to instantaneously stabilize the casting operation; however, the surface quality and strength cannot be achieved, and continuous rolling in an endless rolling mode may be impractical. An edge temperature of the bar plate on an exit side of the rough rolling is more preferably 820° C. to 1080° C., most preferably 850° C. to 1050° C.

When the edge temperature of the bar plate on an exit side of the rough rolling is less than 800° C., large amounts of precipitates, such as NbC, Nb(C,N), (Nb,Ti) (C,N), AlN, BN, and the like, thereby significantly increasing sensitivity to edge crack occurrence in accordance with high temperature ductility. In contrast, when the edge temperature exceeds 1100° C., a center temperature of the thin slab may become too high and a large amount of acid-water scale may be generated, thereby deteriorating the surface quality after pickling.

Removing Bar Plate Scale

Cooling water is sprayed onto the bar plate at a pressure of 50 bars to 350 bars to remove scale. For example, the scale may be removed so as that the thickness of the surface scale becomes 30 μm or less by spraying the cooling water of 50° C. or less from a nozzle of the FSB at a pressure of 50 bars to 350 bars. When the pressure is less than 50 bars, removal of the scale is insufficient, and large amounts of spindle-shaped and fish-scale-shaped scale are formed on a surface of the steel sheet after rolling, thereby deteriorating the surface quality after the pickling. In contrast, pressure above 350 bars would drastically reduce a finish rolling temperature, thereby disabling to obtain an effective austenite fraction and target tensile strength. The pressure of spraying the cooling water is more preferably 100 bars to 300 bars, most preferably 150 bars to 250 bars.

Finishing Rolling

The bar plate from which scale has been removed is subjected to finish rolling within the temperature range of (Ar3-20° C.) to (Ar3+60° C.) to obtain a hot-rolled steel sheet. For example, the finish rolling may be carried out in a finishing mill consisting of 3 to 6 stands. Meanwhile, the conventional hot rolling process has an issue with rolling workpiece transfer characteristics during the rolling at a finish rolling temperature near Ar3. The continuous casting-direct rolling process of the present disclosure, however, constant-temperature, constant-speed rolling is carried out and thus has no operational problems such as deteriorated rolling workpiece transfer characteristics, and the like, thereby facilitating low temperature rolling near the temperature Ar3. This may lead to obtaining of finer grains.

When the finish rolling temperature is less than Ar3-20° C., a roll load greatly increases during the hot rolling, leading to increased energy consumption and low operational speed. Further, as an insufficient austenite fraction is obtained, a target microstructure and a material cannot be secured. In contrast, in the case of the finish rolling temperature exceeding Ar3+60° C., the grains are coarse and high strength cannot be obtained. It is disadvantageous in that to obtain a martensite structure, a cooling speed needs to be high.

The finish rolling may be carried out such that a workpiece transfer speed is 200 mpm to 600 mpm and a thickness of the hot-rolled steel sheet is 2.8 m or less. When the finish rolling speed exceeds 600 mpm, operational problems such as deterioration of rolling workpiece transfer characteristics may occur. In addition, as constant-temperature and constant-speed rolling is impractical, constant temperature is not secured, thereby generating deviations in mechanical properties. In contrast, when the speed is less than 200 mpm, the finish rolling speed is excessively low, thereby making it difficult to obtain a finish rolling temperature. The workpiece transfer speed is more preferably 250 mpm to 550 mpm, most preferably 300 mpm to 500 mpm. A thickness of the hot-rolled steel sheet is more preferably 2.0 mm or less, most preferably 1.6 mm or less.

Cooling and Coiling

After cooling the hot-rolled steel sheet for 2 sec to 8 sec, the hot-rolled steel sheet is cooled at 80° C./sec to 250° C./sec and coiled within the temperature range of (Bs-200° C.) to (Bs+50° C.)

When the cooling is carried out for less than 2 sec, C enrichment to residual austenite is insufficient, and a time for ferrite transformation lacks, thereby increasing risk of reduced elongation. When the cooling is carried out for more than 8 sec, it may be difficult to achieve target tensile strength due to excessive transformation of ferrite. Further, a length of equipment may increase and productivity may decrease.

The cooling may be carried out such that the austenite fraction is 60% to 90% and a ferrite fraction is 10% to 40%. When the austenite fraction is less than 60% before cooling the hot-rolled steel sheet, it may be difficult to obtain a sufficient bainite structure after cooling. In contrast, when the austenite fraction is greater than 90%, it may be difficult to secure ductility due to increased transformation of martensite, a hard tissue.

In addition, when the cooling speed is less than 80° C./sec, ferrite transformation is accelerated, and cementite is formed, thereby making it difficult to obtain a desired material. when the cooling speed is greater than 250° C./sec, martensite transformation is accelerated, and a target bainite cannot be sufficiently obtained, thereby deteriorating workability.

When the coiling temperature is less than Bs−200° C., the martensite transformation is accelerated, and strength excessively increases, thereby making it difficult to obtain elongation. When the coiling temperature exceeds Bs+50° C., it may be difficult to obtain a sufficient bainite structure, and a size of grains becomes coarse, thereby deteriorating workability.

Meanwhile, pickling the coiled hot-rolled steel sheet to obtain a PO product may further be included.

In the present disclosure, as scale is sufficiently removed through the bar slab scale removal and the bar plate scale removal, a PO product having excellent surface quality may be obtained even by conventional pickling. Accordingly, any pickling method used in conventional hot-rolled pickling processes may be employed in the present disclosure without particular limitations.

Hereinafter, the present disclosure will be described more specifically through examples. However, the following examples should be considered in a descriptive sense only and not for purposes of limitation. The scope of the present disclosure is defined by the appended claims, and modifications and variations may be reasonably made therefrom.

MODE FOR INVENTION

Examples

Molten steels having the compositions shown in Table 1 below were prepared.

In the cases of Inventive Examples 1 and 3 and Comparative Examples 1 and 20, a thin slab having a thickness of 90 mm was continuously cast under the manufacturing conditions disclosed in Table 3 to manufacture a hot-rolled steel sheet having a thickness of 1.9 mm in an endless rolling mode through a continuous casting-direct rolling process.

In the case of Conventional Example 1, a slab having a thickness of 250 mm was cast in the conventional hot-rolling mill under the manufacturing conditions disclosed in Table 3 to manufacture a hot-rolled steel sheet having a thickness of 3.1 mm. Multistage cooling refers to cooling involving cooling to 700° C. at a cooling speed of 200° C./sec after finish rolling, followed by cooling to a coiling temperature at a cooling speed of 150° C./sec.

Coiling temperature deviation in Table 3 indicates a value obtained by subtracting a minimum coiling temperature from a maximum coiling temperature, among coiling temperature values measured in a length direction of the strip.

Once a PO product was obtained by pickling the hot-rolled steel sheet, the microstructure, tensile strength (TS), elongation (EL), tensile strength deviation (OTS), bendability (R/t ratios of 0.25 and 0.50), hole expansion ratio (HER), edge crack occurrence and surface quality were measured and disclosed in Table 4 below.

A sum of ferrite and bainitic ferrite (F+BF), and an area fraction of bainite (B) and martensite (M), which is an average value of area percentages obtained by measuring 10 random spots using scanning electron microscope (SEM) images taken at a magnification of 5,000 times and Image-Plus Pro software.

For sizes of short axes of the ferrite (F) and the bainitic ferrite (BF), 10 random spots were measured using SEM images at a magnification of 3,000, and sizes of the short axes were measured using Image-Plus Pro software. An average value is disclosed in Table 4.

The tensile strength and the HER (stretch-flangeability) are values measured using a JIS No. 5 sample taken at a ¼ width position (w/4) in a direction perpendicular to the direction of rolling. Deviations in mechanical properties is calculated by subtracting a minimum TS value from a maximum Ts value, among tensile strength values measured in the length and width directions of the coil. The HER is a value measured by punching a hole having the diameter of 10.8 mm and pushing a cone up into the hole to calculate in percentage a ratio of the initial diameter (10.8 mm) to a diameter of the expanded hole immediately before cracking occurred in a circumferential portion. The HER deviation is a value calculated by subtracting a minimum HER from a maximum HER, among HERs measured in the width direction of the coil.

The occurrence of edge cracks was first observed with naked eyes during intermediate inspection, and second observed using a surface defect detector (SDD) device, a surface defect-defector.

Surface quality of the PO product was evaluated under the following standards. Gloss is a numerical indication of the glassiness of a surface of a PO steel sheet using Rhopoint IQ™.

○: average deviation of glossiness in width direction is 10% or less

Δ: average deviation of glossiness in width direction is 10% to 20% x: average deviation of glossiness in width direction exceeds 20%

Meanwhile, Expulsion Limit Current (ELC), which can be used as an index of weldability in resistance spot welding is calculated using Equation 5 and shown in Table 4. The higher the ELC, the better the resistance spot weldabiltiy.

TABLE 1

| | | Alloying elements (wt %) | | | | | | | | | | |
|---|---|---|---|---|---|---|---|---|---|---|---|---|
| Types | Steels | C | Mn | Si | P | S | Al | Cr | Ti | Nb | B | N |
| IS | A | 0.048 | 2.29 | 0.13 | 0.0074 | 0.0009 | 0.024 | 0.76 | 0.043 | 0.029 | 0.0025 | 0.0054 |
| IS | B | 0.050 | 2.26 | 0.10 | 0.0071 | 0.0014 | 0.025 | 0.74 | 0.042 | 0.030 | 0.0023 | 0.0066 |
| CS | C | 0.049 | 1.55 | 0.11 | 0.0085 | 0.0011 | 0.029 | 0.80 | 0.040 | 0.032 | 0.0025 | 0.0053 |
| CS | D | 0.049 | 2.25 | 0.15 | 0.0080 | 0.0010 | 0.028 | 0.37 | 0.047 | 0.031 | 0.0022 | 0.0056 |
| CS | E | 0.051 | 2.23 | 0.11 | 0.0081 | 0.0011 | 0.030 | 0.81 | 0.095 | 0.034 | 0.0023 | 0.0066 |
| CS | F | 0.047 | 2.29 | 0.12 | 0.0088 | 0.0015 | 0.024 | 0.76 | 0.009 | 0.035 | 0.0024 | 0.0062 |
| CS | G | 0.049 | 2.26 | 0.15 | 0.0080 | 0.0010 | 0.028 | 0.80 | 0.040 | 0.048 | 0.0021 | 0.0052 |
| CS | H | 0.051 | 2.21 | 0.11 | 0.0079 | 0.0014 | 0.025 | 0.81 | 0.041 | 0.001 | 0.0025 | 0.0059 |
| CS | I | 0.053 | 2.30 | 0.11 | 0.0090 | 0.0013 | 0.028 | 0.82 | 0.045 | 0.032 | 0.0049 | 0.0052 |
| CS | J | 0.051 | 2.32 | 0.13 | 0.0075 | 0.0011 | 0.025 | 0.88 | 0.042 | 0.030 | 0.0006 | 0.0061 |
| CS | K | 0.050 | 2.29 | 0.65 | 0.0091 | 0.0011 | 0.029 | 0.78 | 0.041 | 0.031 | 0.0022 | 0.0062 |
| CoS | L | 0.049 | 1.69 | 1.07 | 0.0070 | 0.0016 | 0.029 | 0.75 | 0.070 | 0.035 | 0.0008 | 0.0048 |

*IS: Inventive Steel,

**CS: Comparative Steel,

***CoS: Conventional Steel

TABLE 2

| Types | Steels | Equation 1 LL | Equation 1 UL | Equation 2 LL | Equation 2 UL | Equation 3 LL | Equation 3 UL | Equation 4 |
|---|---|---|---|---|---|---|---|---|
| IS | A | 0.018 | 0.068 | 0.016 | 0.036 | 0.0008 | 0.0043 | 0.18 |
| IS | B | 0.022 | 0.072 | 0.024 | 0.044 | 0.0018 | 0.0053 | 0.18 |
| CS | C | 0.018 | 0.068 | 0.015 | 0.035 | 0.0007 | 0.0042 | 0.15 |
| CS | D | 0.019 | 0.069 | 0.017 | 0.037 | 0.0010 | 0.0045 | 0.19 |
| CS | E | 0.022 | 0.072 | 0.024 | 0.044 | 0.0018 | 0.0053 | 0.19 |
| CS | F | 0.021 | 0.071 | 0.021 | 0.041 | 0.0015 | 0.0050 | 0.19 |
| CS | G | 0.018 | 0.068 | 0.014 | 0.034 | 0.0007 | 0.0042 | 0.19 |
| CS | H | 0.020 | 0.070 | 0.019 | 0.039 | 0.0012 | 0.0047 | 0.19 |
| CS | I | 0.018 | 0.068 | 0.014 | 0.034 | 0.0007 | 0.0042 | 0.19 |
| CS | J | 0.021 | 0.071 | 0.020 | 0.040 | 0.0014 | 0.0049 | 0.19 |

TABLE 2-continued

| Types | Steels | Equation 1 LL | Equation 1 UL | Equation 2 LL | Equation 2 UL | Equation 3 LL | Equation 3 UL | Equation 4 |
|---|---|---|---|---|---|---|---|---|
| CS | K | 0.021 | 0.071 | 0.021 | 0.041 | 0.0015 | 0.0050 | 0.21 |
| CoS | L | 0.016 | 0.066 | 0.012 | 0.032 | 0.0003 | 0.0038 | 0.19 |

*IS: Inventive Steel,
**CS: Comparative Steel,
***CoS: Conventional Steel,
****LL: Lower Limit,
*****UL: Upper Limit Lower limits and upper limits of Equations 1 to 3 were calculated for each steel and indicated in Table 2 above. Each element symbol in Equations 1 to 4 refers to a content of each element expressed in wt %.

$$3.4N \le Ti \le 3.4N+0.05 \quad \text{Equation 1:}$$

$$6.6N-0.02 \le Nb \le 6.6N \quad \text{Equation 2:}$$

$$0.8N-0.0035 \le B \le 0.8N, \quad \text{Equation 3:}$$

$$Ceq=C+Si/30+Mn/20+2P+3S \quad \text{Equation 4:}$$

TABLE 3

| Types | Steels | RSB (Bar) | FSB (Bar) | Finish rolling temp (□) | Ar3 (□) | Bs (□) | Ms (□) | Air-cooling time (sec) | ROT Cooling speed (□/sec) | Coiling temp (□) |
|---|---|---|---|---|---|---|---|---|---|---|
| IE 1 | A | 210 | 165 | 781 | 769 | 533 | 399 | 3.9 | 130 | 544 |
| IE 2 | B | 195 | 166 | 785 | 765 | 531 | 396 | 3.8 | 140 | 535 |
| CE 1 | | 200 | 165 | 783 | | | | 0.5 | 135 | 535 |
| CE 2 | | 205 | 150 | 786 | | | | 8.6 | 145 | 530 |
| CE 3 | | 200 | 155 | 784 | | | | 3.8 | 280 | 230 |
| CE 4 | | 195 | 160 | 789 | | | | 3.7 | 72 | 635 |
| CE 5 | | 55 | 150 | 780 | | | | 3.5 | 140 | 535 |
| CE 6 | | 205 | 45 | 785 | | | | 3.2 | 135 | 532 |
| CE 7 | | 200 | 385 | 740 | | | | 4.1 | 135 | 536 |
| CE 8 | C | 195 | 160 | 785 | 825 | 583 | 446 | 3.8 | 135 | 535 |
| CE 9 | D | 200 | 155 | 789 | 785 | 541 | 409 | 3.9 | 145 | 539 |
| CE 10 | E | 210 | 160 | 786 | 775 | 537 | 405 | 3.7 | 130 | 530 |
| CE 11 | F | 205 | 165 | 785 | 780 | 533 | 398 | 3.6 | 135 | 533 |
| CE 12 | G | 195 | 155 | 789 | 787 | 532 | 401 | 3.8 | 140 | 530 |
| CE 13 | H | 200 | 160 | 780 | 770 | 535 | 400 | 3.5 | 145 | 539 |
| CE 14 | I | 200 | 155 | 784 | 765 | 532 | 396 | 3.6 | 135 | 530 |
| CE 15 | J | 205 | 165 | 783 | 775 | 529 | 395 | 3.9 | 140 | 530 |
| CE 16 | K | 195 | 155 | 787 | 779 | 499 | 389 | 4.0 | 135 | 539 |
| CoE1 | L | 35 | 160 | 900 | 845 | 504 | 414 | — | Multistage cooling | 445 |

*IE: Inventive Example,
**CE: Comparative Example,
***CoE: Conventional Example

The roughing mill scale breaker (RSB) in Table 3 above refers to a spraying pressure of cooling water before rough rolling, and the finishing mill scale breaker (FSB) is a spraying pressure of cooling water after rough rolling. The Ar3, the Bs and the Ms refer to temperatures at which ferrite, bainite and martensite begin to transform, respectively, and are values calculated using Jmat-Pro-v0.1, commercial thermodynamic software.

TABLE 4

| Types | Steels | Phrase fraction (%) F + BF | B | M | Short axis size (μm) | TS (MPa) | EL (%) | TSXEL (MPaX %) | ΔTS (MPa) | Bendability (R/t) 0.25 | 0.50 | HER (%) | ΔHER (%) | Edge crack occurrence | PO product surface quality | Eq 5 |
|---|---|---|---|---|---|---|---|---|---|---|---|---|---|---|---|---|
| IE 1 | A | 56 | 40 | 4 | 2.3 | 848 | 19 | 16,112 | 13 | ○ | ○ | 69 | 16 | X | ○ | 9.13 |
| IE 2 | B | 57 | 39 | 4 | 2.1 | 841 | 19 | 15,979 | 14 | ○ | ○ | 71 | 15 | X | ○ | 9.16 |

TABLE 4-continued

| Types | Steels | Phrase fraction (%) F + BF | B | M | Short axis size (μm) | TS (MPa) | EL (%) | TSXEL (MPaX %) | ΔTS (MPa) | Bendability (R/t) 0.25 | 0.50 | HER (%) | ΔHER (%) | Edge crack occurrence | PO product surface quality | Eq 5 |
|---|---|---|---|---|---|---|---|---|---|---|---|---|---|---|---|---|
| CE 1 | | 32 | 67 | 1 | 2.3 | 869 | 14 | 12,166 | 20 | X | ○ | 45 | 21 | X | ○ | |
| CE 2 | | 81 | 15 | 4 | 2.2 | 750 | 21 | 15,750 | 13 | ○ | ○ | 89 | 19 | X | ○ | |
| CE 3 | | 56 | 19 | 25 | 2.1 | 895 | 11 | 9,845 | 21 | X | X | 36 | 22 | X | ○ | |
| CE 4 | | 88 | 12 | 0 | 2.0 | 690 | 28 | 19,320 | 12 | ○ | ○ | 105 | 15 | X | ○ | |
| CE 5 | | 56 | 40 | 4 | 2.1 | 845 | 19 | 16,055 | 15 | ○ | ○ | 69 | 17 | X | X | |
| CE 6 | | 56 | 39 | 5 | 2.1 | 835 | 20 | 16,700 | 17 | ○ | ○ | 68 | 18 | X | X | |
| CE 7 | | 90 | 1 | 1 | 1.8 | 685 | 22 | 15,070 | 15 | ○ | ○ | 69 | 28 | X | ○ | |
| CE 8 | C | 94 | 4 | 2 | 3.1 | 669 | 23 | 15,387 | 17 | ○ | ○ | 109 | 15 | X | ○ | 9.28 |
| CE 9 | D | 75 | 22 | 3 | 2.3 | 785 | 24 | 18,840 | 16 | ○ | ○ | 75 | 16 | X | ○ | 9.19 |
| CE 10 | E | 60 | 39 | 1 | 1.6 | 901 | 8 | 7,208 | 21 | X | X | 31 | 25 | X | ○ | 9.14 |
| CE 11 | F | 55 | 41 | 4 | 3.7 | 779 | 24 | 18,696 | 16 | ○ | ○ | 95 | 15 | ○ | ○ | 9.14 |
| CE 12 | G | 54 | 43 | 3 | 1.5 | 889 | 11 | 9,779 | 15 | X | ○ | 39 | 21 | ○ | ○ | 9.11 |
| CE 13 | H | 55 | 40 | 5 | 3.6 | 779 | 24 | 18,696 | 19 | ○ | ○ | 73 | 18 | X | ○ | 9.15 |
| CE 14 | I | 49 | 48 | 3 | 1.9 | 885 | 10 | 8,850 | 21 | X | ○ | 41 | 19 | ○ | ○ | 9.13 |
| CE 15 | J | 82 | 14 | 4 | 2.3 | 751 | 22 | 16,522 | 19 | ○ | ○ | 89 | 16 | X | ○ | 9.10 |
| CE 16 | K | 61 | 37 | 2 | 2.6 | 815 | 20 | 16,300 | 16 | ○ | ○ | 75 | 19 | X | Δ | 8.74 |
| CoE1 | L | 81 | 19 | 0 | 5.2 | 827 | 18 | 14,886 | 39 | ○ | ○ | 56 | 31 | — | Δ | 8.55 |

In Table 4 above, Equation 5 is ELC (kA)=9.85−0.74Si−0.67Al−0.28C−0.20Mn−0.18Cr. Each element symbol in Equations 1 to 4 refers to a content of each element expressed in wt %.

Inventive Examples 1 and 2, which satisfy all the conditions suggested in the present disclosure, satisfied the target tensile strength (at least 800 mPa) and elongation (at least 15%) and did not involve crack occurrence at bendability R/t of 0.25 and 0/50. The HER also satisfied the target value (at least 50%), and the edge and PO product surface qualities were shown to be excellent. Particularly, Inventive Examples 1 and 2 had significantly low tensile strength and HER as well as excellent HER and surface quality compared to Conventional Example 1.

In addition, as shown in Table 4, all Inventive Steel showed higher ELC values and had excellent weldability compared to Conventional Steel.

Figure 2:
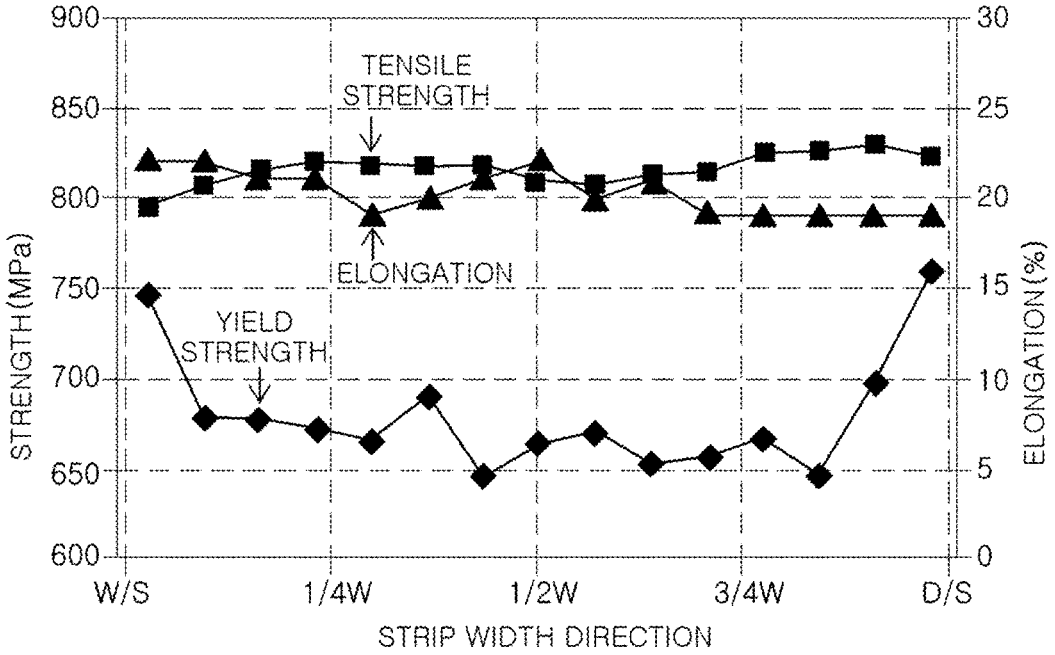
FIG. 2 is a profile of Conventional Example 1.

FIGS. 1 and 2 are evaluation results of profiles of Inventive Example 2 and Conventional Example 1, and indicate that compared to Conventional Steel, the Inventive Steel invented in the present disclosure had significantly low deviations in mechanical properties in the width direction.

Figure 3:
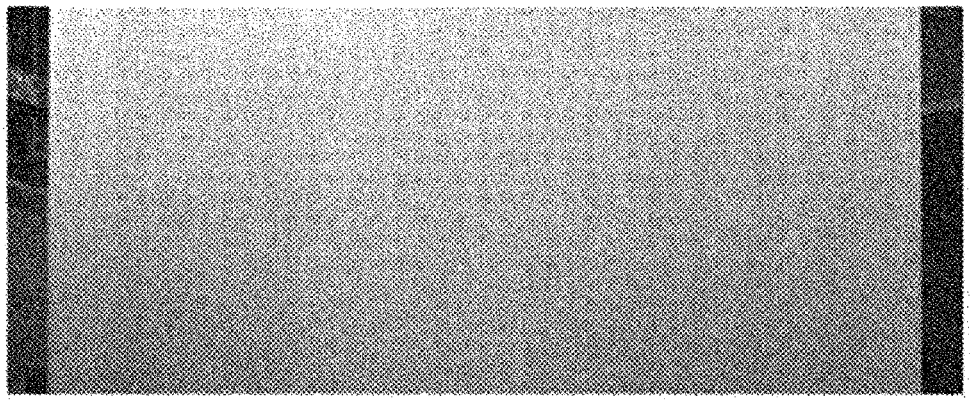
FIG. 3 is a photographic image of a surface of a PO strip of Inventive Example 2.
Figure 4:
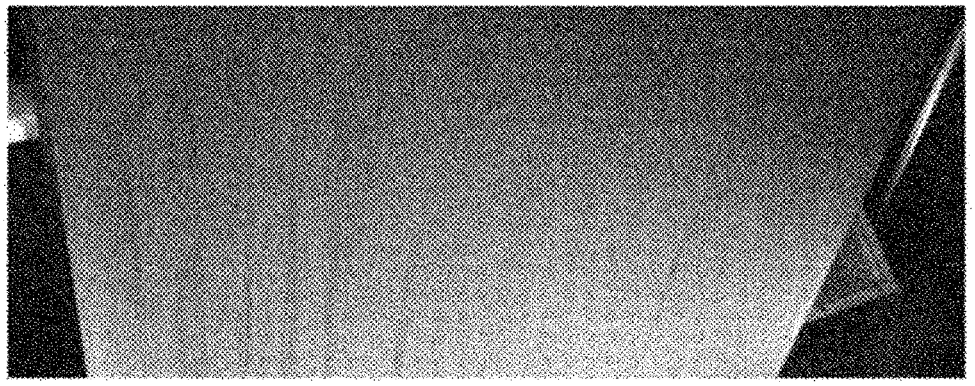
FIG. 4 is a photographic image of a surface of a PO strip of Conventional Example 1.

FIGS. 3 and 4 are photographic images of surfaces of PO strips of Inventive Example 2 and Conventional Example 2, and indicate that the Inventive Steel has better surface quality than Conventional Steel.

Figure 5:
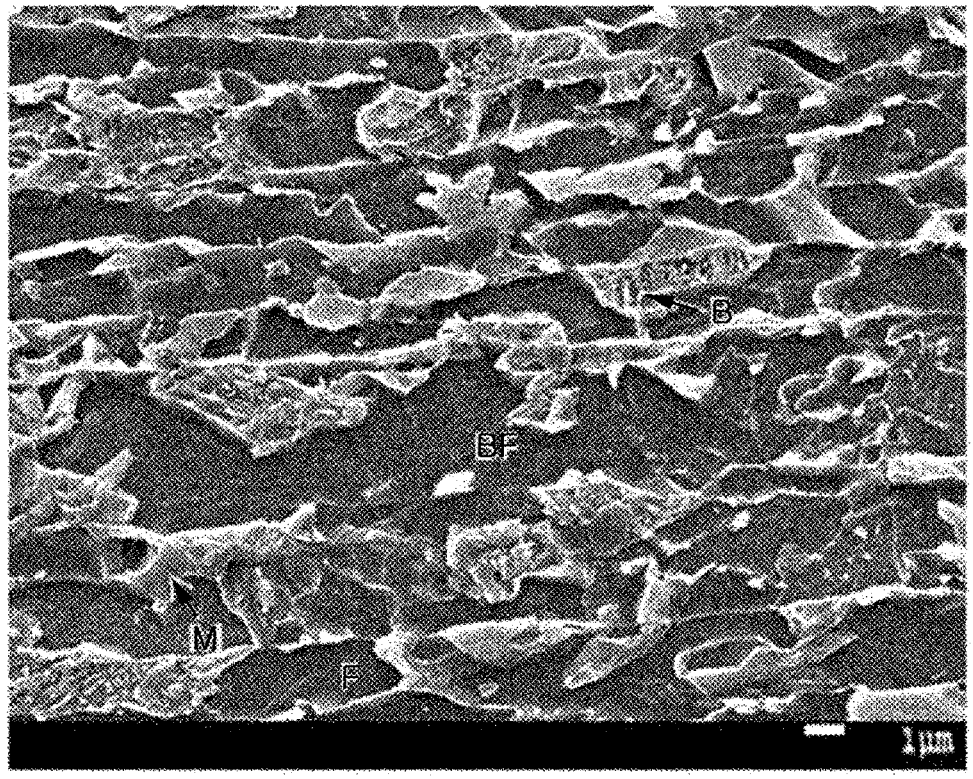
FIG. 5 is a scanning electron microscope (SEM) image of a microstructure of Inventive Example 2.

FIG. 5 is a scanning electron microscope (SEM) image of a microstructure of Inventive Example 2 at a magnification of 5,000. The microstructure includes ferrite (F), bainitic ferrite (BF) and bainite (B) as main phases, and martensite (M) is partially present. SEM and Image-Plus Pro were used to measure an area fraction of each microstructure, and the result indicates that the microstructure has F+BF 57%, B 39% and M 4%. As shown in Table 4, the fraction of B, a structure capable of securing strength and workability, was higher than that of Conventional Example 1.

SEM and Image Plus Pro were further used to measure a size of the short axis of the F+BF microstructure, and an average was 2.01 μm. As shown in Table 4, the F+BF microstructure was about 2 times finer than Conventional Steel, which is understood to be due to low temperature rolling.

Figure 6:
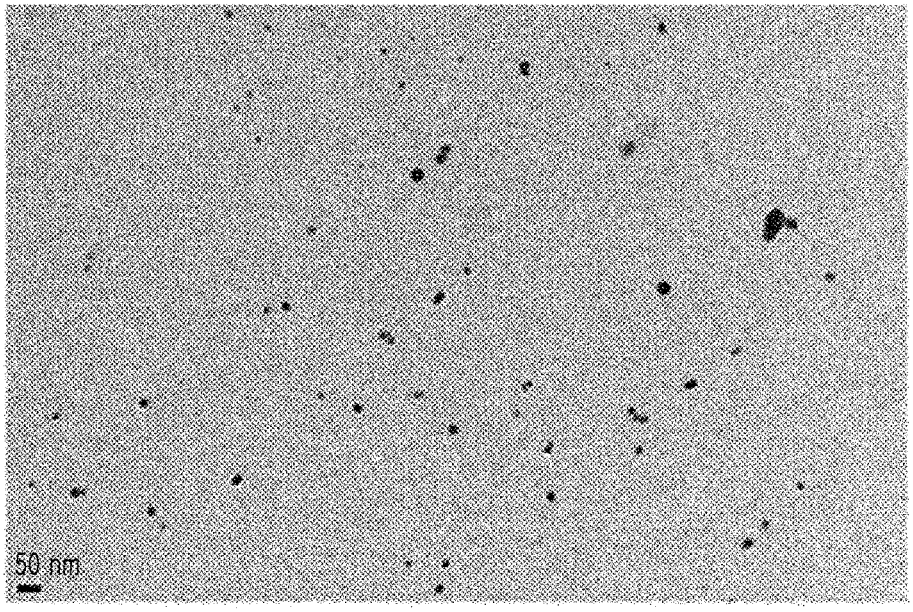
FIG. 6 is a transmission electron microscope (TEM) image of a precipitate of Inventive Example 2.

FIG. 6 is a transmission electron microscope (TEM) image of a precipitate of Inventive Example 2. It is shown that fine precipitates, such as (Ti, Nb) (C, N), and the like, are uniformly distributed in a matrix structure. An average size of the precipitates is 15 nm and an average number thereof is 20/pmt. The precipitate number is measured by preparing a sample via a carbon replica method, taking a TEM image of the microstructure at a magnification of 80,000, and measuring a number of precipitates present in a 1 μm×1 μm square in the TEM image followed by calculating an average of 50 random precipitates.

The air cooling time, cooling speed, coiling temperature, suggested in the present disclosure, were not satisfied in Comparative Examples 1 to 4, and thus, the microstructure, tensile properties, bendability and hole expansion ratio, targeted in the present disclosure, were also not obtained.

Comparative Examples 5 and 6 did not satisfy the RSB and FSB pressures suggested in the present disclosure and thus resulted in deteriorated surface quality.

Comparative Example 7 did not satisfy the FSB pressure suggested in the present disclosure, which caused the finish rolling temperature to be lower than Ar3-20° C. Accordingly, a sufficient austenite fraction was not obtained, and the target microstructure and tensile strength were unable to be satisfied.

Comparative Examples 8 and 9 are the cases in which the Mn and Cr contents are lower than those suggested in the present disclosure, and thus fail to obtain the target microstructure and tensile strength.

Comparative Example 10 is the case in which the Ti content exceeds the upper limit of Equation 1. In this case, the target microstructure fraction was satisfied; however, Ti-based precipitates were excessively formed and ferrite ductility was reduced. Consequently, the target elongation, bendability and hole expansion ratio were not satisfied.

Comparative Example 12 is the case in which the Nb content exceeds the upper limit of Equation 2, and Comparative Example 14 is the case in which the B content exceeds the upper limit of Equation 3. In both cases, excessive precipitates, such as NbC, Nb(C,N), BN, and the like, which adversely affect the high temperature ductility, were formed, thereby deteriorating the edge quality. The elongation, bendability and hole expansion ratio were not satisfied.

Figure 7:
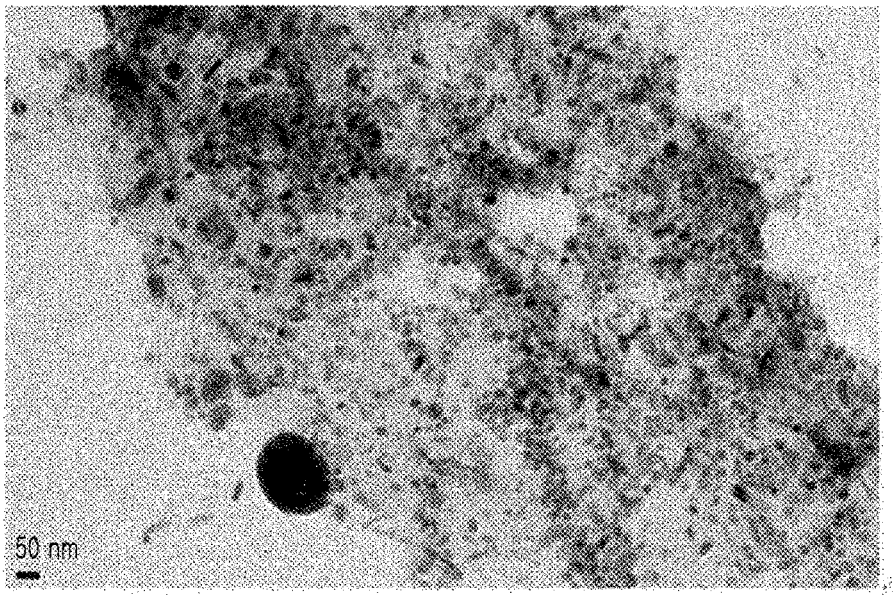
FIG. 7 is a TEM image of a precipitate of Comparative Example 12.

FIG. 7 is a TEM image of a precipitate of Comparative Example 12. As shown in the microstructure below, Comparative Example 11 did not reach the Ti content suggested in the present disclosure, while Comparative Example 13 did not reach the Nb content suggested in the present disclosure. Comparative Example 15 is a case in which the B content did not reach the lower limit of Equation 3, thereby failing to obtain the target tensile strength.

Comparative Example 16 did not satisfy the Si component suggested in the present disclosure, and resulted in deteriorated surface quality.

While embodiments have been shown and described above, it will be apparent to those skilled in the art that modifications and variations could be made without departing from the scope of the present disclosure as defined by the appended claims.

DESCRIPTIONS OF REFERENCE NUMERALS

A: SLAB
B: COIL
100: CONTINUOUS CASTING MACHINE
200: HEATER
300: RSB (ROUGHING MILL SCALE BREAKER)
400: ROUGHING MILL
500: FSB (FINISHING MILL SCALE BREAKER)
600: FINISHING MILL
700: RUN-OUT TABLE
800: HIGH SPEED SHEAR MACHINE
900: COILER

The invention claimed is:

1. A hot-rolled steel sheet, the rolled steel sheet comprising:

by wt %, carbon (C): 0.03% to 0.08%, manganese (Mn): 1.6% to 2.6%, silicon (Si): 0.1% to 0.6%, phosphorous (P): 0.005% or 0.03%, sulfur (S): 0.01% or less, aluminum (Al): 0.05% or less, chromium (Cr): 0.4% to 2.0%, titanium (Ti): 0.01% to 0.1%, niobium (Nb): 0.005% to 0.1%, boron (B): 0.0005% to 0.005%, nitrogen (N): 0.001% to 0.01%, and retained iron (Fe) and inevitable impurities;

a microstructure comprising, by area %, a sum of ferrite and bainitic ferrite of 30% to 70%, bainite of 25% to 65%, and martensite of 5% or less, wherein the ferrite and the bainitic ferrite have an average short-axis length of 1 μm to 5 μm;

a tensile strength of at least 800 MPa;

deviations of 20 MPa or less in the tensile strength in a width direction of the hot-rolled steel sheet;

an average deviation of 10% or less in a glossiness in a width direction of the hot-rolled steel sheet, wherein the glossiness is measured by a surface gloss measurement with a numerical indication of the glassiness; and $5/\mu m^2$ to $100/\mu m^2$ of (Ti,Nb)(C,N) precipitates, wherein the (Ti,Nb)(C,N) precipitates have an average equivalent circular diameter of 50 nm or less.

2. The hot-rolled steel sheet of claim 1, wherein the Ti, the Nb and the B satisfy Equations 1 to 3, $$3.4N \le Ti \le 3.4N+0.05 \quad \text{Equation 1}$$

$$6.6N-0.02 \le Nb \le 6.6N \quad \text{Equation 2}$$

$$0.8N-0.0035 \le B \le 0.8N \quad \text{Equation 3,}$$

where each element symbol in Equations 1 to 3 refers to a content of each element expressed in wt %.

3. The hot-rolled steel sheet of claim 1, further comprising: at least one of copper (Cu), nickel (Ni), molybdenum (Mo), tin (Sn) and lead (Pb) as a tramp element, wherein a total amount of the tramp element is 0.2 wt % or less.

4. The hot-rolled steel sheet of claim 1, further comprising: Ceq of 0.10 to 0.24, the Ceq being expressed by Equation 4 below, Equation 4: Ceq=C+Si/30+Mn/20+2P+3S, where each element symbol refers to a content of each element in wt %.

5. The hot-rolled steel sheet of claim 1, further comprising: a thickness of 2.8 mm or less.

6. The hot-rolled steel sheet of claim 1, further comprising: an elongation of at least 15% and a hole expandability of at least 50%, wherein the hot-rolled steel sheet does not involve cracking at a bendability R/t ratio of 0.25.

* * * * *